US009250564B2

(12) United States Patent
Hashimoto et al.

(10) Patent No.: US 9,250,564 B2
(45) Date of Patent: Feb. 2, 2016

(54) DEVELOPING DEVICE AND IMAGE FORMING APPARATUS

(71) Applicant: CANON KABUSHIKI KAISHA, Tokyo (JP)

(72) Inventors: Kazunori Hashimoto, Numazu (JP); Masato Koyanagi, Ibaraki (JP); Gosuke Goto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/464,590

(22) Filed: Aug. 20, 2014

(65) Prior Publication Data

US 2015/0055991 A1 Feb. 26, 2015

(30) Foreign Application Priority Data

Aug. 23, 2013 (JP) ..... 2013-173700

(51) Int. Cl.
*G03G 15/08* (2006.01)
*G03G 15/06* (2006.01)

(52) U.S. Cl.
CPC ..... *G03G 15/0812* (2013.01); *G03G 15/065* (2013.01)

(58) Field of Classification Search
CPC ..... G03G 15/065; G03G 15/0812; G03G 15/081; G03G 15/0822
USPC ..... 399/279, 284, 286
See application file for complete search history.

(56) References Cited

U.S. PATENT DOCUMENTS

| | | | | | |
|---|---|---|---|---|---|
| 4,564,285 | A * | 1/1986 | Yasuda | G03G 15/0928 | 399/274 |
| 5,170,213 | A * | 12/1992 | Yamaguchi | G03G 15/0812 | 399/281 |
| 5,870,658 | A * | 2/1999 | Goto | G03G 15/0812 | 399/284 |
| 6,094,555 | A * | 7/2000 | Katoh | G03G 15/0812 | 399/274 |
| 2013/0223891 | A1* | 8/2013 | Koyanagi et al. | | 399/279 |
| 2015/0055990 | A1* | 2/2015 | Koyanagi | G03G 15/0822 | 399/284 |

FOREIGN PATENT DOCUMENTS

| | | | |
|---|---|---|---|
| JP | 04-127177 | A | 4/1992 |
| JP | 4-218079 | A | 8/1992 |
| JP | 3272056 | B2 | 4/2002 |
| WO | 2013/128551 | A1 | 9/2013 |

* cited by examiner

*Primary Examiner* — Francis Gray
(74) *Attorney, Agent, or Firm* — Canon USA Inc. IP Division

(57) ABSTRACT

A developing device includes a developer bearing member that bears a developer on its surface to supply the developer to an image bearing member having a first dielectric portion and a second dielectric portion in its surface, a regulating member that regulates a thickness of a layer of the developer carried by the developer bearing member, and a flexible sheet-like charging auxiliary member disposed so as to be in contact with the developer bearing member at a position downstream of a contact portion between the developer bearing member and the image bearing member and upstream of a contact portion between the developer bearing member and the regulating member in a rotational direction of the developer bearing member, where the charging auxiliary member charges the developer carried by the developer bearing member. In a triboelectric series, the charging auxiliary member is positioned between the first and second dielectric portions.

14 Claims, 13 Drawing Sheets

DEVELOPING DEVICE AND IMAGE FORMING APPARATUS

BACKGROUND OF THE INVENTION

1. Field of the Invention

The present invention relates to a developing device and an image forming apparatus including the developing device.

2. Description of the Related Art

The following type of developing device used in image forming apparatuses, such as laser printers, has been developed. That is, the developing device includes a toner supplying roller that supplies toner (developer) to a developing roller (a developer bearing member) and removes the toner carried by the developing roller. The toner supplying roller is mainly used to prevent solid image follow-up failure and ghosting. As used herein, the term "solid image follow-up failure" refers to a phenomenon that when 100% solid image is drawn as an entire image, the density of part of the image in the trailing edge area decreases. In addition, the term "ghosting" refers to a phenomenon that when, for example, a halftone image or a solid white image is formed after a solid image having a high density is formed, part of the solid image is left on the halftone image or the solid white image.

In recent years, a developing device that does not have the above-described toner supplying roller has been developed in order to reduce the size and cost of the developing device. In such a case, some other way needs to be found to prevent the occurrence of the solid image follow-up failure and ghosting.

Japanese Patent No. 3272056 describes a developing device without a toner supplying roller. The developing device includes a developing roller (a developer bearing member) having a surface in which dielectric portions and conductive portions are regularly or irregularly arranged. In such a configuration, a development blade (a regulating member) slides on the dielectric portions of the surface of the developing roller directly or via toner so as to charge the dielectric portions. Thus, a minute closed electric field (hereinafter referred to as a "microfield") is formed on the border between the dielectric portion and the conductive portion. Upon receiving a gradient force generated by the microfield, toner particles are attracted to the surface of the developing roller and, thus, are carried by the surface of the developing roller.

Alternatively, Japanese Patent Laid-Open No. 4-218079 describes a developing roller that allows a plurality of types of substance having different chargeabilities to be regularly or irregularly exposed from the developing roller. Among the substances, at least two substances are charged by a charging member to form a plurality of microfields in the vicinity of the developing roller. Upon receiving a gradient force generated by the microfields, toner particles are attracted to the surface of the developing roller and, thus, are carried by the surface of the developing roller.

Still alternatively, Japanese Patent Laid-Open No. 4-127177 describes the following configuration. That is, a triboelectric charging roller is disposed downstream of a developing portion, which is a contact portion between a developing roller and an image bearing member, in the rotational direction of the developing roller. The triboelectric charging roller slides on dielectric portions of the developing roller to charge the dielectric portions. By charging the dielectric portions in this manner, a microfield is formed on the border between the dielectric portion and a conductive portion. Upon receiving a gradient force generated by the microfield, toner particles are attracted to the surface of the developing roller and, thus, are carried by the surface of the developing roller.

The developing device described in Japanese Patent No. 3272056 is configured so that if the toner is charged to a negative polarity, a triboelectric series of (−) the toner<the development blade<the dielectric portion (+) is given. In such a configuration, since the toner carried by the dielectric portions is electrostatically and firmly attracted to the dielectric portions, it is difficult for the development blade to regulate the toner. Accordingly, when a solid white image is formed, the amount of toner coat on the developing roller is sometimes larger than when a solid image is formed. Thus, the difference between the amounts of toner coat may cause ghosting in an image.

In addition, although the development blade can control the amount of toner coat, the development blade cannot remove toner on the developing roller, unlike a toner supplying roller. Accordingly, if images having a low coverage rate are continuously output, toner may be fusion bonded to the developing roller, which causes an image defect. To prevent such an image defect, the lifetime of the developing device needs to be set to be short.

In addition, like the developing devices described in Japanese Patent Laid-Open No. 4-218079 and Japanese Patent Laid-Open No. 4-127177, in the configuration including a toner supplying roller and a triboelectric charging roller, toner on the developing roller is strongly pressed against the developing roller or is stripped off from the developing roller. Accordingly, the toner may be fusion bonded to the developing roller, or the quality of the toner may be deteriorated. As a result, an image defect may occur. To prevent such an image defect, the lifetime of the developing device needs to be set to be short.

SUMMARY OF THE INVENTION

Accordingly, the present invention provides a compact and low-cost developing device capable of reducing the occurrence of an image defect.

According to an aspect of the present invention, a developing device includes a developer bearing member configured to bear a developer on a surface thereof in order to supply the developer to an image bearing member, where the developer bearing member has a first dielectric portion and a second dielectric portion in the surface thereof, a regulating member configured to regulate a thickness of a layer of the developer carried by the developer bearing member, and a flexible sheet-like charging auxiliary member disposed so as to be in contact with the developer bearing member at a position downstream of a contact portion between the developer bearing member and the image bearing member and upstream of a contact portion between the developer bearing member and the regulating member in a rotational direction of the developer bearing member, where the charging auxiliary member charges the developer carried by the developer bearing member. In a triboelectric series, the charging auxiliary member is positioned between the first dielectric portion and the second dielectric portion.

Further features of the present invention will become apparent from the following description of exemplary embodiments with reference to the attached drawings.

DESCRIPTION OF THE EMBODIMENTS

Exemplary embodiments of the present invention are described in detail below with reference to the accompanying drawings. Note that its elements are very flexible in size, material, shape and relative positional relationship and should be changed in accordance with the configuration and various conditions of the apparatus of the invention. That is, the scope of the invention is not limited by the following exemplary embodiments.

Figure 13:
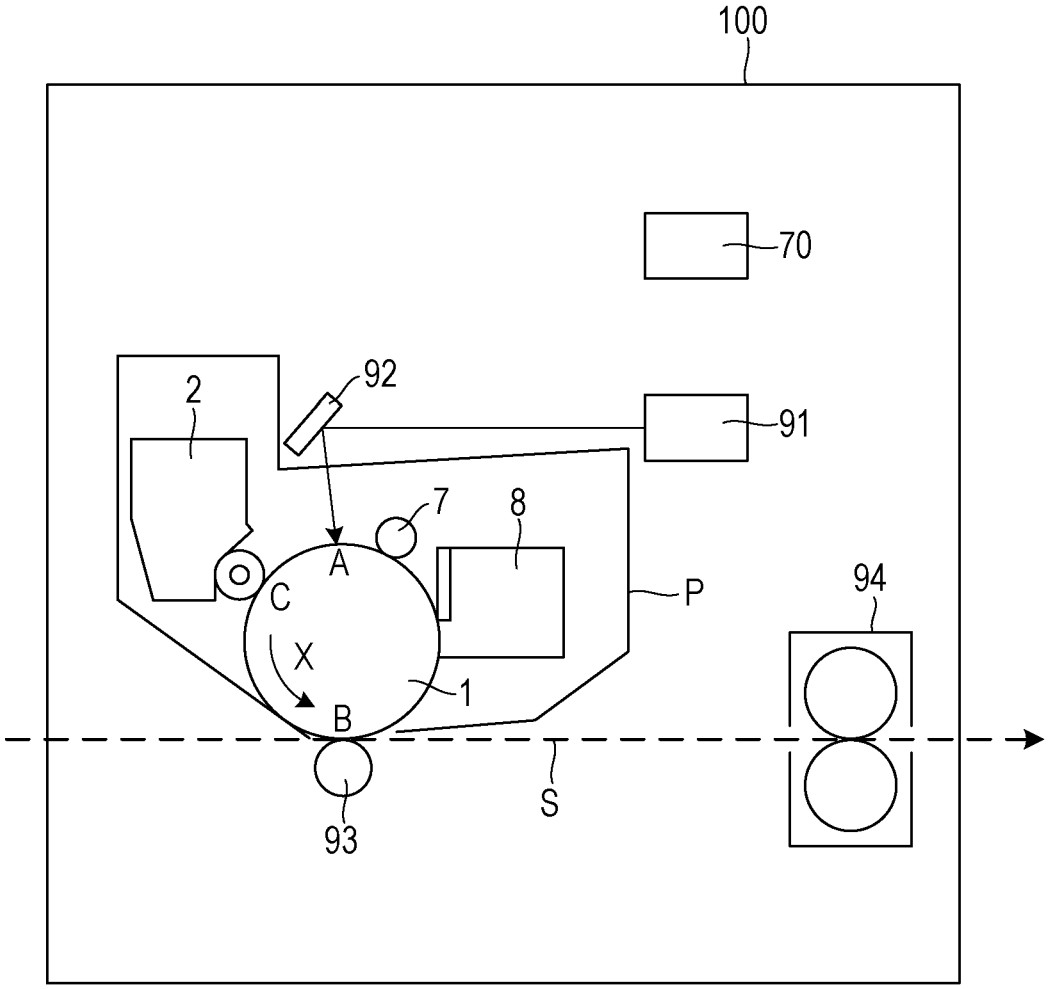
FIG. 13 is a schematic cross-sectional view of an image forming apparatus according to an exemplary embodiment.

The image forming apparatus according to an exemplary embodiment is described first with reference to FIG. 13. FIG. 13 is a schematic cross-sectional view of the image forming apparatus according to the present exemplary embodiment. An image forming apparatus 100 according to the present exemplary embodiment includes a photosensitive drum 1, a developing device 2, a cleaning device 8, a charging roller 7, an exposure device 91, a transfer roller 93, and a fixing unit 94.

The photosensitive drum 1, the developing device 2, the cleaning device 8, and the charging roller 7 are integrated into one body, which serves as a process cartridge P. The process cartridge P can be removably mounted in an image forming apparatus main body (a portion of the image forming apparatus 100 other than the process cartridge P). The developing device 2 contains toner serving as developer having a negative polarity as a normal charge polarity (a charge polarity for developing an electrostatic latent image). Note that according to the present exemplary embodiment, since an electrostatic latent image having a negative polarity is reversal developed, the normal charge polarity is negative.

A laser beam is emitted from the exposure device 91. The exposure device 91 and a reflective mirror 92 are disposed so that the laser bean reaches an exposure position A in the photosensitive drum 1 via the reflective mirror 92. The transfer roller 93 is disposed below the photosensitive drum 1. After an image is transferred, a transfer material S, such as a paper sheet, is conveyed to the fixing unit 94. The cleaning device 8 is disposed downstream of the transfer position in a direction in which the photosensitive drum 1 moves so that a blade of the cleaning device 8 can be in contact with the photosensitive drum 1 and remove the toner on the photosensitive drum 1.

The image forming operation performed by the image forming apparatus is described below. A controller unit 70 controls the overall image forming operation described below in accordance with a predetermined program and a reference table. The controller unit 70 charges the surface of the photosensitive drum 1 having an external diameter of 24 mm and rotating at a speed of 150 mm/sec in a direction of an arrow X using the charging roller 7 so that the surface is charged to a predetermined potential first. Thereafter, an electrostatic latent image is formed on the photosensitive drum 1 at the exposure position A in accordance with an image signal using the laser beam emitted from the exposure device 91. The formed electrostatic latent image is developed at a development position C using the developing device 2. Thus, a toner image is formed as a developer image. The toner image formed on the photosensitive drum 1 is transferred onto the transfer material S at a transfer position B. The transfer material S having the toner image transferred thereonto is conveyed to the fixing unit 94. The fixing unit applies pressure and heat to the toner image on the transfer material S to fix the toner image onto the transfer material S. The fixed toner image serves as a final image.

First Exemplary Embodiment

Figure 1:
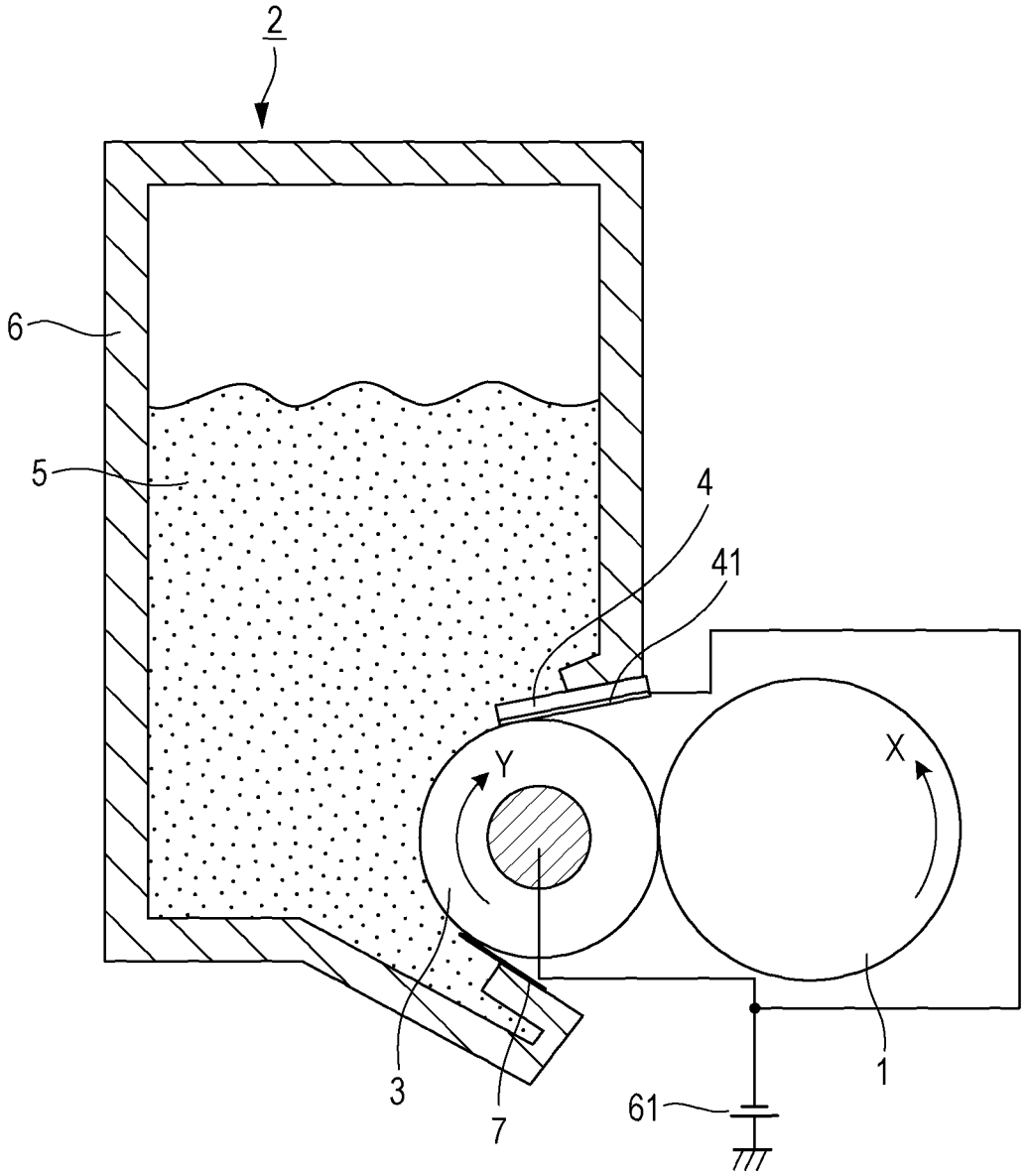
FIG. 1 is a schematic cross-sectional view of a developing device according to a first exemplary embodiment.

The developing device 2 according to a first exemplary embodiment is described below with reference to FIG. 1. FIG. 1 is a schematic cross-sectional view of a developing device according to the first exemplary embodiment. The developing device 2 according to the first exemplary embodiment is used as a developing device of an electrophotographic image forming apparatus, such as a laser printer. As illustrated in FIG. 1, the developing device 2 includes a developing roller 3 serving as a developer bearing member, a development blade 4 serving as a regulating member, a developer container 6, and a charging auxiliary sheet 7 serving as a charging auxiliary member.

Hereinafter, a contact portion between the developing roller 3 and the photosensitive drum 1 serving as the image bearing member is referred to as a developing unit, and a contact portion between the developing roller 3 and the development blade 4 is referred to as a regulating unit. According to the first exemplary embodiment, the developing roller 3 is disposed so as to be in contact with the photosensitive drum 1.

The developer container 6 contains toner 5 serving as a nonmagnetic one-component developer. The developing roller 3 is rotatingly driven in a direction of an arrow Y at a peripheral speed of 180 mm/sec. In addition, the development blade 4 controls the thickness of a layer of toner carried by the developing roller 3. Furthermore, the development blade 4 includes a charged layer 41. The development blade 4 serves as a charge supplying device that supplies predetermined charge to the dielectric portions of the developing roller 3 via the toner 5 and a developer charging device that supplies predetermined charge to the toner 5.

In addition, the charging auxiliary sheet 7 is disposed downstream of the developing unit and upstream of the regulating unit in the rotational direction of the developing roller 3. The charging auxiliary sheet 7 is a flexible sheet-like charging auxiliary member. The charging auxiliary sheet 7 also serves as a developer leakage prevention sheet that seals the developer container 6 to prevent the toner 5 from leaking out of the developer container 6.

Note that the developing device 2 according to the first exemplary embodiment does not include a toner supplying roller serving as the developer feed member that feeds toner to the developing roller 3 and removes toner carried by the developing roller 3.

The developing roller 3 has first dielectric portions 31 and a second dielectric portion 32 in its surface (refer to FIGS. 2A and 2B described below). The first dielectric portion 31 and the second dielectric portion 32 have different work functions. The charged layer 41 of the development blade 4 and the charging auxiliary sheet 7 slide against the first dielectric portions 31 and the second dielectric portion 32 directly or via the toner. In this manner, the dielectric portions are charged at different potentials and, thus, a microfield is formed above a border portion between the dielectric portions. The toner conveyed onto the surface of the developing roller 3 receives a gradient force generated by the microfield. Thus, the toner is attracted to a surface of the developing roller 3, and toner is carried by the surface of the developing roller 3. In this manner, according to the first exemplary embodiment, the developing roller 3 bears a multilayer of toner on the surface thereof using the gradient force.

The developing roller according to the first exemplary embodiment is described in detail below with reference to FIGS. 2A and 2B and FIG. 3. FIGS. 2A and 2B are schematic illustrations of the developing roller according to the first exemplary embodiment. FIG. 2A is a plan view of the developing roller according to the first exemplary embodiment, and FIG. 2B is a cross-sectional view taken along a line IIB-IIB of FIG. 2A. FIG. 3 is a schematic cross-sectional view of another example of the developing roller.

According to the first exemplary embodiment, the developing roller 3 is configured so that microregions of the first dielectric portion 31 and microregions of the second dielectric portion 32 are dispersed and exposed throughout the surface. The first dielectric portion 31 has a high specific resistance that can maintain charge therein. In contrast, the second dielectric portion 32 has a medium specific resistance that maintains a certain amount of charge and allows the charge to attenuate. The first dielectric portion 31 and the second dielectric portion 32 are brought in contact with the toner 5, the charged layer 41 of the development blade 4, and the charging auxiliary sheet 7 so as to be charged to different potentials. As a result, the microfields indicated by lines E of electric force illustrated in FIG. 2B are formed on the surface of the developing roller 3.

The first dielectric portion 31 is formed so as to be, for example, a square having sides of about 5 to 500 μm. This size is optimal to maintain charge on the surface and reduce the occurrence of uneven density of an image. If the side<5 μm, the amount of charge maintained on the surface of the first dielectric portion 31 is small and, thus, it is difficult to form a sufficient microfield. In contrast, if the side>500 μm, the difference in potential between the first dielectric portion 31 and the second dielectric portion is too large and, thus, an image of uneven density is formed.

Figure 2A:
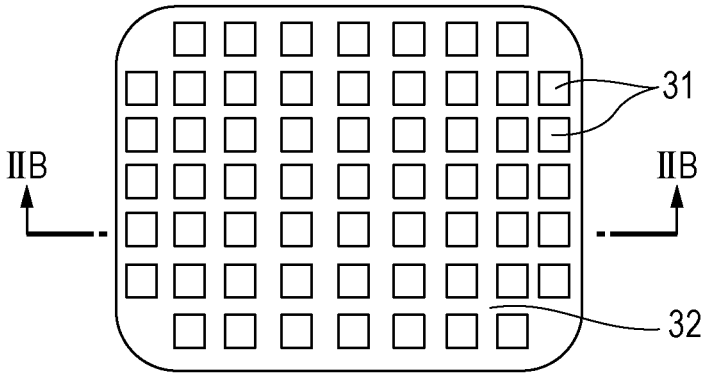
FIGS. 2A and 2B are schematic illustrations of the developing roller according to the first exemplary embodiment.
Figure 2B:
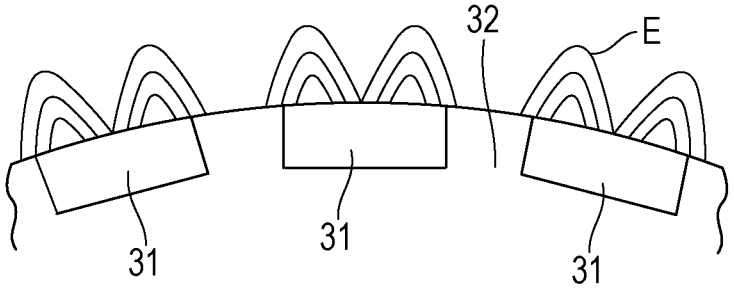
Figure 3:
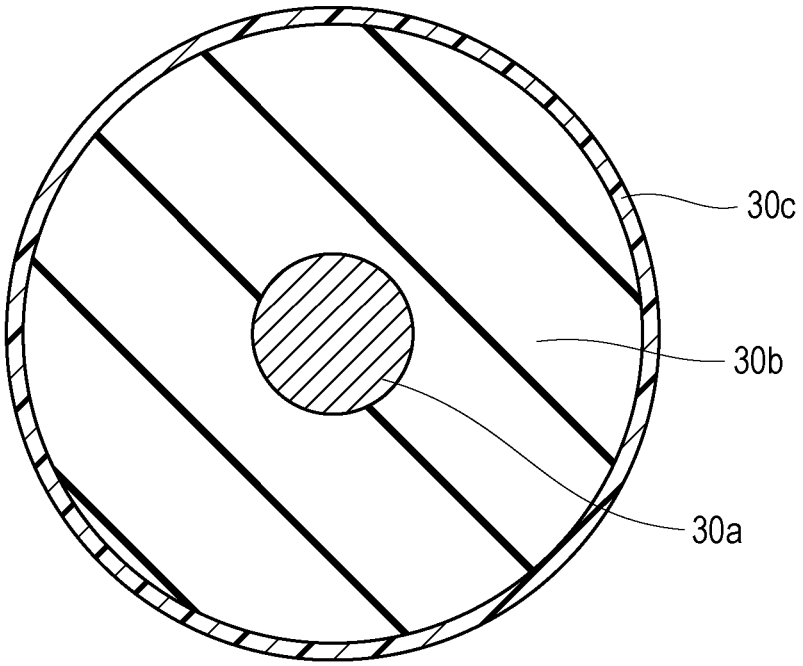
FIG. 3 is a schematic cross-sectional view of another example of the developing roller.

To form a surface layer portion illustrated in FIGS. 2A and 2B, a polyurethane resin, for example, is used for the second dielectric portion 32. The polyurethane resin is applied to a conductive base made of aluminum, iron, or copper to an approximately 0.5 mm thickness. Subsequently, the first dielectric portions 31 each made of the polyethylene resin, which has a work function that significantly differs from that of the polyurethane resin, are fusion bonded to the surface of the second dielectric portion 32. At that time, each of the first dielectric portions 31 has sides of 200 μm and a thickness of 50 μm. In this manner, the developing roller 3 having the second dielectric portion 32 made of a polyurethane resin and the first dielectric portions 31 made of the polyethylene resin is achieved. According to the first exemplary embodiment, the total area of the second dielectric portion 32 is set to 50% of the entire surface (i.e., the total area of the first dielectric portions 31 is set to 50% of the entire surface).

According to the first exemplary embodiment, a contact developing method in which the developing roller 3 is in contact with the photosensitive drum 1 is employed. Accordingly, to prevent the photosensitive drum 1 from being damaged, it is desirable that the developing roller 3 be an elastic roller having a hardness in the range of 30 to 70 degrees (JISA) when measured from the surface.

Note that a method for forming microregions of the minute first dielectric portion 31 and second dielectric portion 32 is not limited to the method described above. A variety of method may be employed. For example, as illustrated in FIG. 3, an elastic layer 30*b* made of a conductive rubber material may be coated on the outer periphery of a mandrel 30*a*, and a surface layer 30*c* made of a resin material having dielectric particles dispersed therein may be coated on the elastic layer 30*b*. Thereafter, microregions of the first dielectric portions 31 and second dielectric portion 32 may be formed by polishing the surface layer 30*c*.

According to the first exemplary embodiment, to charge the developing roller 3, a relationship among the work functions of the first dielectric portion 31 and the second dielectric portion 32 of the surface of the developing roller 3 and the charging auxiliary sheet 7 is used. When measured using a surface analyzer (Model AC-2 available from Riken Keiki Co., Ltd.) and an amount of emitted light of 250 nW, the work function of the material used for the first dielectric portion 31 of the surface of the developing roller 3 was 5.57 eV. When measured in the same manner, the work function of the material used for the second dielectric portion 32 of the surface of the developing roller 3 was 5.86 eV. In the first exemplary embodiment, a polyimide resin sheet having a thickness of 0.1 mm was used as the charging auxiliary sheet 7. When measured in the same manner, the work function of the charging auxiliary sheet 7 was 5.78 eV.

In addition, in the first exemplary embodiment, a DC development bias of −300 V was applied to the developing roller 3 using a development bias applying unit 61 serving as a first voltage applying unit illustrated in FIG. 1. In addition, a latent image design for the photosensitive drum 1 was such that a solid white image portion has −500 V and a solid image portion has −100 V using a charging device (not illustrated) and the exposure device. In the first exemplary embodiment, to obtain an optimal image density, the amount of toner coat on the photosensitive drum 1 needs to be 0.54 mg/cm$^2$ when a solid image is formed. Accordingly, the amount of toner coat on the developing roller 3 needs to be 0.45 mg/cm$^2$.

In the first exemplary embodiment, the materials of the first dielectric portion 31, the second dielectric portion 32, and the charging auxiliary sheet 7 of the developing roller 3 are selected so that the work functions of the materials generate a triboelectric series of (−) the second dielectric portion 32<the charging auxiliary sheet 7<the first dielectric portion 31 (+). Such a configuration allows, after a solid image is printed, the first dielectric portion 31 to have charge of a positive polarity due to friction between the charging auxiliary sheet 7 and the first dielectric portion 31 and allows the second dielectric portion 32 to have charge of a negative polarity due to friction between the charging auxiliary sheet 7 and the second dielectric portion 32.

Figure 4A:
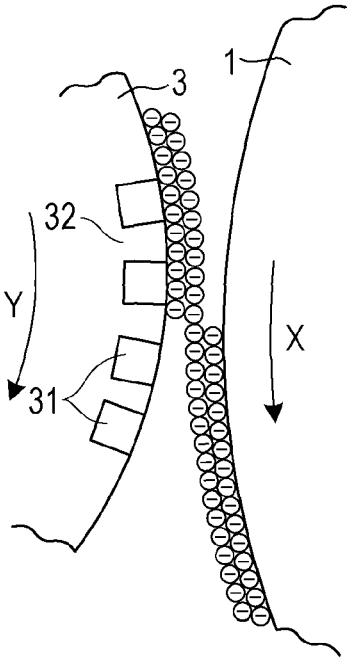
FIGS. 4A and 4B are schematic cross-sectional views illustrating the charge conditions when a solid image is formed according to the first exemplary embodiment.
Figure 4B:
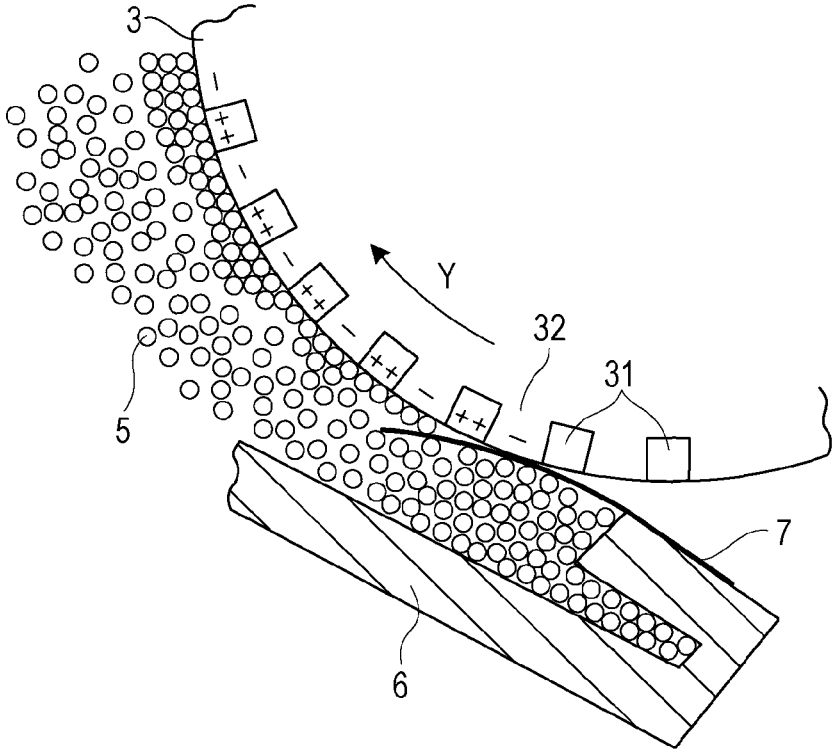

A mechanism for reducing the solid image follow-up failure according to the first exemplary embodiment is described below with reference to FIGS. 4A and 4B. FIGS. 4A and 4B are schematic cross-sectional views illustrating the charge conditions of the first dielectric portion 31, the second dielectric portion 32, and the toner 5 when a solid image is formed according to the first exemplary embodiment. FIG. 4A illustrates the developing unit and its vicinity, and FIG. 4B illustrates a contact portion between the developing roller 3 and the charging auxiliary sheet 7 and its vicinity. As used herein, the term "solid image follow-up failure" refers to a phenomenon in which the density of the trailing edge portion of an image decreases after 100% solid image is formed in an entire page.

According to the first exemplary embodiment, the whole toner coated on the developing roller 3 is used for development when a solid image is formed. In FIGS. 4A and 4B, the toner particles indicated by outlined circles represent non-charged or low-charged toner particles. The toner particles indicated by outlined circles with "–" sign inside represent toner particles that are regulated (rubbed) by the surface of the developing roller 3 and the charged layer 41 of the development blade 4 and that are negatively charged.

The solid image formation is described below. As illustrated in FIG. 4A, when a solid image is formed, the whole toner on the developing roller 3 is developed in the developing unit and is transferred onto the photosensitive drum 1. Accordingly, after the development process is completed, no toner 5 exists on the developing roller 3. Since no toner exists on the developing roller 3, the first dielectric portion 31 and the second dielectric portion 32 are in direct contact with the charging auxiliary sheet 7 in the contact portion between the developing roller 3 and the charging auxiliary sheet 7, as illustrated in FIG. 4B. Thus, the first dielectric portion 31 and the second dielectric portion 32 are friction charged.

At that time, as described above, a triboelectric series of (–) the second dielectric portion 32<the charging auxiliary sheet 7<the first dielectric portion 31 (+) is established. Accordingly, the first dielectric portion 31 is charged to a positive polarity, and the second dielectric portion 32 is charged to a negative polarity. Thus, a microfield is formed between the first dielectric portion 31 and the second dielectric portion 32. Thereafter, in the developer container 6, about three layers of toner are formed due to the gradient force generated by the microfield formed on the developing roller 3. Accordingly, even after a solid image is printed, the developing roller 3 can bear a sufficient amount of toner for forming an image. Thus, a uniform solid image can be continuously printed without the occurrence of a solid image follow-up failure.

As described above, according to the first exemplary embodiment, the developing device 2 is configured so that microregions of the first dielectric portion 31 and the second dielectric portion 32 are mixedly dispersed and exposed throughout the surface of the developing roller 3. In addition, the first dielectric portions 31, the second dielectric portions 32, and the charging auxiliary sheet 7 are configured so that a triboelectric series of (–) the second dielectric portion 32<the charging auxiliary sheet 7<the first dielectric portion 31 (+) is established. Furthermore, the charging auxiliary sheet 7 is disposed downstream of the developing unit in the rotational direction of the developing roller 3. Such configurations allow a microfield to be formed between the first dielectric portion 31 and the second dielectric portion 32 after a solid image is printed. Accordingly, even after a solid image is printed, the developing roller 3 can bear a sufficient amount of toner due to the gradient force generated by the microfield. Thus, uniform solid images can be continuously printed without the occurrence of a solid image follow-up failure.

In this manner, according to the first exemplary embodiment, a compact and low-cost developing device that does not include a toner supplying roller can reduce the solid image follow-up failure and deterioration of toner. When 1000 images of an A4 size were formed using the image forming apparatus illustrated in FIG. 13 including the developing device according to the first exemplary embodiment illustrated in FIG. 1, an optimum image density was able to be maintained without an image defect and, thus, an excellent image was able to be obtained.

In addition, in the first exemplary embodiment, the contact pressure between the charging auxiliary sheet 7 and the developing roller 3 was set to such contact pressure that the toner can pass through a gap between the charging auxiliary sheet 7 and the developing roller 3. Accordingly, the stress imposed on the toner was able to be reduced. As described above, by using a flexible sheet member as the charging auxiliary member, the stress imposed on toner can be reduced.

Furthermore, according to the first exemplary embodiment, an insulating polyimide resin sheet is used as the charging auxiliary sheet 7. If the charging auxiliary sheet 7 and the first dielectric portion 31 are friction charged, the charging auxiliary sheet 7 is charged to a negative polarity. In contrast, if the charging auxiliary sheet 7 and the second dielectric portion 32 are friction charged, the charging auxiliary sheet 7 is charged to a positive polarity. In this manner, since positive charge and negative charge alternately appear, charge-up of the charging auxiliary sheet 7 can be prevented. Accordingly, the charging ability of the charging auxiliary sheet 7 does not decrease. Thus, the charging auxiliary sheet 7 can reliably charge the first dielectric portions 31 having a high specific resistance and the second dielectric portion 32 having a medium specific resistance in the surface of the developing roller 3 so as to form microfields.

According to the first exemplary embodiment, the first dielectric portion 31 is formed of a dielectric material having a high specific resistance, and the second dielectric portion 32 is formed of a dielectric material having a medium specific resistance. However, the materials are not limited thereto. For example, the first dielectric portion 31 may be formed of a dielectric material having a medium specific resistance, and the second dielectric portion may be formed of a dielectric material having a high specific resistance. Alternatively, the first dielectric portion 31 and the second dielectric portion 32 may be formed of a dielectric material having a high specific resistance or a dielectric material having a medium specific resistance.

In the first exemplary embodiment, the first dielectric portion 31, the second dielectric portion 32, and the charging auxiliary sheet 7 are configured in accordance with the above-described material configuration. However, any other material configuration that establishes the triboelectric series of (–) the second dielectric portion 32<the charging auxiliary sheet 7<the first dielectric portion 31 (+) may be employed.

In the first exemplary embodiment, the contact developing method in which the photosensitive drum 1 is in contact with the developing roller 3 is employed. However, a noncontact developing method in which the photosensitive drum 1 is not in contact with the developing roller 3 in order to eliminate the pressure applied to the toner may be employed.

Second Exemplary Embodiment

A second exemplary embodiment is described below with reference to FIGS. 5A to 5C, FIGS. 6A to 6C, FIGS. 7A to 7F, FIGS. 8A to 8F, FIGS. 9A and 9B, and FIGS. 10A and 10B.

Like the first exemplary embodiment, according to the second exemplary embodiment, the surface of the developing roller 3 is configured so that microregions of the first dielectric portion 31 and the second dielectric portion are mixedly exposed on the surface. In addition, according to the second exemplary embodiment, the materials of the first dielectric portion 31, the second dielectric portion 32, the charging auxiliary sheet 7, the toner 5, and the charged layer 41 are selected so that a triboelectric series of (−) the toner 5<the second dielectric portion 32<the charging auxiliary sheet 7<the first dielectric portion 31<the charged layer 41 (+) is established.

Like the first exemplary embodiment, according to the second exemplary embodiment, to measure the work functions of the materials of the charged layer 41 and the toner 5, a surface analyzer (Model AC-2 available from Riken Keiki Co., Ltd.) was used by emitting an amount of light of 250 nW. In addition, according to the second exemplary embodiment, the development blade 4 was formed by forming the charged layer 41 through a lamination process in which a polyamide resin having a thickness of 0.1 mm is stacked on a phosphor-bronze metal thin plate having a thickness of 0.1 mm. At that time, the work function of the charged layer 41 was 5.42 eV. Furthermore, a negatively charged toner made of nonmagnetic styrene-acrylic based and polyester based resin was used as the toner 5 according to the second exemplary embodiment. At that time, the work function of the toner 5 was 6.01 eV.

According to the second exemplary embodiment, the materials of the first dielectric portion 31 and the second dielectric portion 32 of the developing roller 3, the charged layer 41 of the development blade 4, the charging auxiliary sheet 7, and the toner 5 were selected from among the materials that meet the following conditions of the work function:

(−) the toner 5<The second dielectric portion 32<the charging auxiliary sheet 7<the first dielectric portion 31<the charged layer 41 (+) in the triboelectric series. By using such a material configuration, charge of a negative polarity can be provided to the toner 5 due to friction between the toner 5 and each of the first dielectric portion 31 and the second dielectric portion 32. In addition, due to friction between the charged layer 41 and each of the first dielectric portion 31 and the second dielectric portion 32, charge of a positive polarity can be provided to the charged layer 41.

In addition, after a solid image is printed, charge of a positive polarity can be provided to the first dielectric portion 31 due to friction between the charging auxiliary sheet 7 and the first dielectric portion 31, and charge of a negative polarity can be provided to the second dielectric portion 32 due to friction between the charging auxiliary sheet 7 and the second dielectric portion 32.

Furthermore, the friction between the toner 5 and each of the first dielectric portion 31 and the second dielectric portion 32 and friction between the charged layer of the development blade 4 and each of the first dielectric portion 31 and the second dielectric portion 32 generate a potential difference between the developing roller 3 and the charged layer 41 so that the toner 5 moves toward the development blade 4.

Figure 5A:
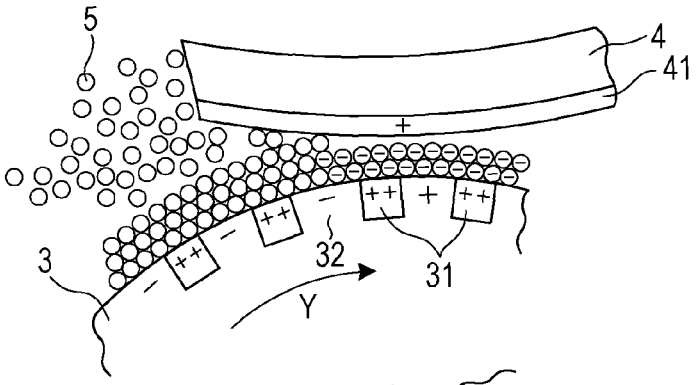
FIGS. 5A to 5C are schematic cross-sectional views illustrating the charge conditions when a solid image is formed according to a second exemplary embodiment.
Figure 5B:
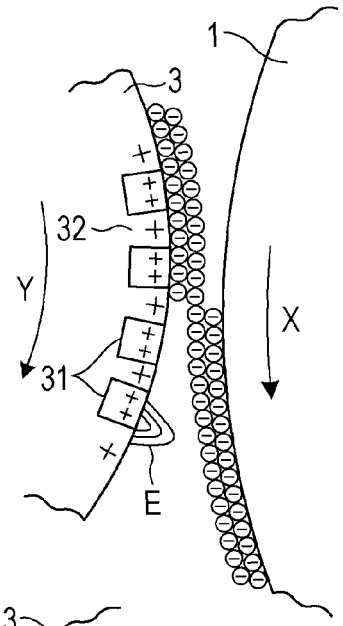
Figure 5C:
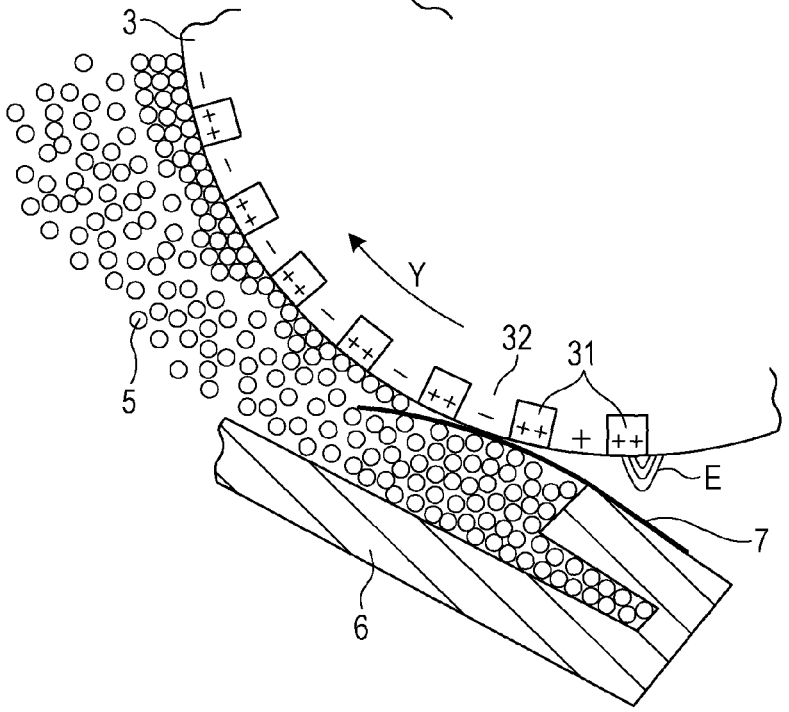
Figure 6A:
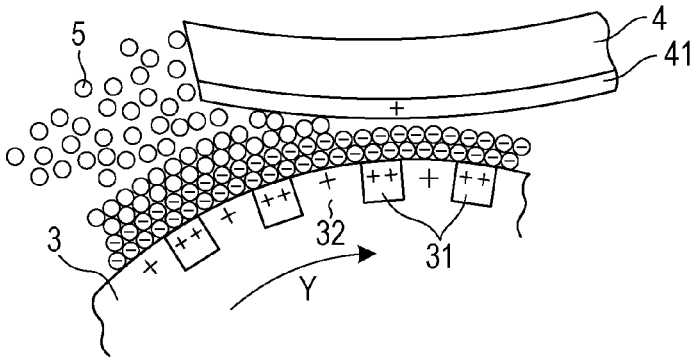
FIGS. 6A to 6C are schematic cross-sectional views illustrating the charge conditions when a solid white image is formed according to the second exemplary embodiment.
Figure 6B:
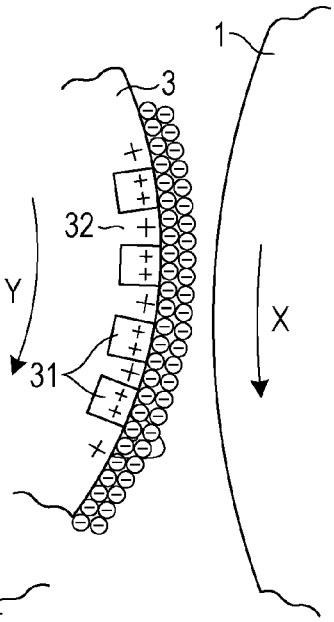
Figure 6C:
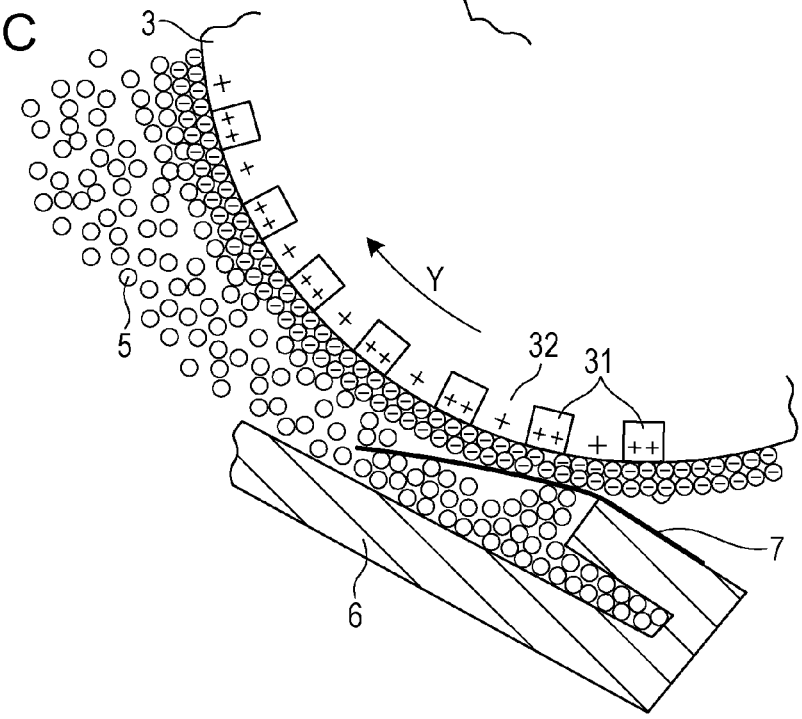

A development system according to the second exemplary embodiment is described below with reference to FIGS. 5A to 5C and FIGS. 6A to 6C. FIGS. 5A to 5C are schematic cross-sectional views illustrating the charge conditions of the first dielectric portion 31, the second dielectric portion 32, and the toner 5 when a solid image is formed, according to the second exemplary embodiment. FIG. 5A illustrates the regulating unit and its vicinity. FIG. 5B illustrates the developing unit and its vicinity. FIG. 5C illustrates the contact portion between the developing roller and the charging auxiliary sheet 7 and its vicinity. FIGS. 6A to 6C are schematic cross-sectional views illustrating the charge conditions of the first dielectric portion 31, the second dielectric portion 32, and the toner 5 when a solid white image is formed, according to the second exemplary embodiment. FIG. 6A illustrates the regulating unit and its vicinity. FIG. 6B illustrates the developing unit and its vicinity. FIG. 6C illustrates the contact portion between the developing roller 3 and the charging auxiliary sheet 7 and its vicinity.

According to the second exemplary embodiment, the whole toner coated on the developing roller 3 is used for development when a solid image is formed. Note that the toner particles indicated by outlined circles illustrated in FIGS. 5A to 5C and FIGS. 6A to 6C are non-charged or low-charged toner particles. The toner particles indicated by outlined circles with "−" sign inside represent toner particles that are regulated by the surface of the developing roller 3 and the charged layer 41 of the development blade 4 and that are negatively charged.

Prevention of a solid image follow-up failure occurring when a solid image is formed is described first with reference to FIGS. 5A to 5C. As illustrated in FIG. 5A, charge of a negative polarity is provided to the toner 5 due to friction between the toner 5 and each of the charged layer 41, the first dielectric portion 31, and the second dielectric portion 32 in the regulating unit. In addition, charge of a positive polarity is provided to each of the charged layer 41, the first dielectric portion 31, and the second dielectric portion 32. Although charge of a positive polarity is provided to the first dielectric portion 31 and the second dielectric portion 32, the potentials of the charge differ from each other and, thus, a microfield is formed.

Thereafter, as illustrated in FIG. 5B, the whole toner on the developing roller 3 is developed in the developing unit and is transferred onto the photosensitive drum 1. Accordingly, after the development process is completed, no toner 5 exists on the developing roller 3. Since no toner exists on the developing roller 3, the first dielectric portion 31 and the second dielectric portion 32 are in direct contact with the charging auxiliary sheet 7 in the contact portion between the developing roller 3 and the charging auxiliary sheet 7, as illustrated in FIG. 5B. Thus, the first dielectric portion 31 and the second dielectric portion 32 are friction charged.

At that time, like the first exemplary embodiment, according to the second exemplary embodiment, a triboelectric series of (−) the second dielectric portion 32<the charging auxiliary sheet 7<the first dielectric portion 31 (+) is established. Accordingly, the first dielectric portion 31 is charged to a positive polarity, and the second dielectric portion 32 is charged to a negative polarity. Thus, a microfield is formed between the first dielectric portion 31 and the second dielectric portion 32.

Thereafter, in the developer container 6, about three layers of toner are formed due to the gradient force generated by the microfield formed on the developing roller 3. Accordingly, as illustrated in FIG. 5A, even after a solid image is printed, the developing roller 3 can bear about three layers of toner. Thus, the occurrence of a solid image follow-up failure can be prevented.

Prevention of a solid image follow-up failure occurring when a solid white image is formed is described next with reference to FIGS. 6A to 6C. Like the case in which a solid image is formed, as illustrated in FIG. 6A, charge of a negative polarity is supplied to the toner 5 in the regulating unit due to friction between the toner 5 and each of the charged layer 41, the first dielectric portion 31, and the second dielectric portion 32. In addition, charge of a positive polarity is supplied to the charged layer 41, the first dielectric portion 31, and the second dielectric portion 32. Although the first dielectric portion 31 and the second dielectric portion 32 have a positive polarity, the potentials differs from each other. Accordingly, a microfield is formed.

In addition, as illustrated in FIG. 6B, the toner 5 on the developing roller 3 is not transferred to the photosensitive drum 1 in the developing unit and, thus, remains on the developing roller 3. Thereafter, as illustrated in FIG. 6C, the charging auxiliary sheet 7, the toner 5, the first dielectric portion 31, and the second dielectric portion 32 are charged due to friction between the toner 5 and each of the charging auxiliary sheet 7, the first dielectric portion 31, and the second dielectric portion 32 in the contact portion between the developing roller 3 and the charging auxiliary sheet 7. Charge of a negative polarity is provided to the toner 5, and charge of a positive polarity is provided to the first dielectric portion 31 and the second dielectric portion 32.

In addition, about four layers of toner are formed in the developer container 6 due to the gradient force generated by the microfield formed on the developing roller 3. Accordingly, as illustrated in FIG. 6A, even after a solid white image is printed, the amount of toner coat corresponding to about four layers of toner can be obtained on the developing roller 3. As a result, the solid image follow-up failure can be prevented.

As described above using FIGS. 5A to 5C and FIGS. 6A to 6C, according to the second exemplary embodiment, the amount of toner coat after the toner passes through the regulating unit when a solid image is formed can be made the same as the amount of toner coat after the toner passes through the regulating unit when a solid white image is formed. As a result, the occurrence of a ghost image can be prevented.

A mechanism for reducing the occurrence of a ghost image according to the second exemplary embodiment is described in detail below with reference to FIGS. 7A and 7F, FIGS. 8A to 8F, and FIGS. 9A and 9B. As used herein, the term "ghosting" refers to a phenomenon in which when, for example, a halftone image or a solid white image is formed after a high-density solid image is formed, some pattern of the solid image appears in the halftone image or the solid white image.

In FIGS. 7A and 7F and FIGS. 8A to 8F, the toner particles indicated by outlined circles represent non-charged or low-charged toner particles. The toner particles indicated by outlined circles with "–" sign inside represent toner particles that are regulated by the surface of the developing roller 3 and the charged layer 41 of the development blade 4 and that are charged and toner particles that are charged by rolling on the surface of the developing roller 3.

Figure 7A:
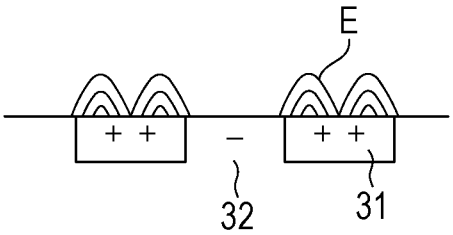
FIGS. 7A to 7F illustrate a mechanism for toner to attach to the developing roller according to the second exemplary embodiment.
Figure 7D:
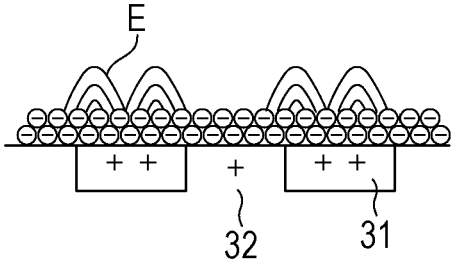
Figure 7B:
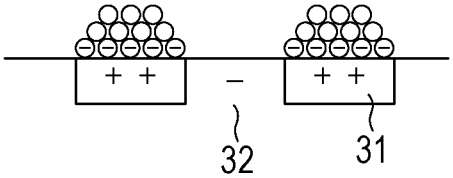
Figure 7E:
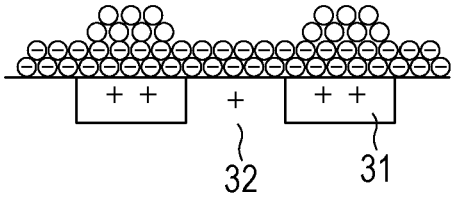
Figure 7C:
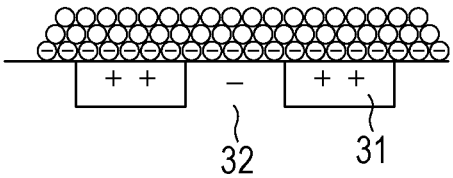
Figure 7F:
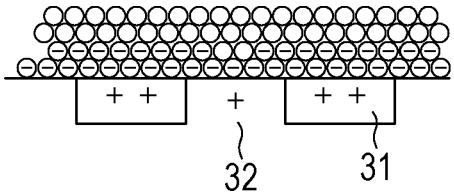

A mechanism by which toner is attracted to the surface of the developing roller 3 is described first with reference to FIGS. 7A and 7F. FIGS. 7A and 7F illustrates the mechanism by which toner is attracted to the surface of the developing roller 3 according to the second exemplary embodiment. More specifically, FIGS. 7A and 7C illustrates the mechanism by which toner is attracted to the surface of the developing roller 3 when a solid image is formed. FIGS. 7D and 7F illustrates the mechanism by which toner is attracted to the surface of the developing roller 3 when a solid white image is formed.

After a solid image is formed, toner is not coated on the surface of the developing roller 3. Thus, the developing roller 3 is in direct slide contact with the charging auxiliary sheet 7. Accordingly, as illustrated in FIG. 7A, the first dielectric portion 31 is charged to a positive polarity, and the second dielectric portion 32 is charged to a negative polarity. As a result, a microfield E is formed.

Thereafter, as illustrated in FIG. 7B, non-charged or low-charged toner particles are attracted to the surface of the first dielectric portion 31 that forms the microfield E due to the gradient force. The toner particles that are brought into contact with the surface of the developing roller 3 are charged to "–" (negative). As illustrated in FIG. 7B, the attracted toner particles form irregularities on the surface of the developing roller 3. The surface irregularities trap the toner 5, and about three layers of toner are formed, as illustrated in FIG. 7C.

In contrast, after a solid white image is formed, a – (negative) charge of the toner coat is accumulated on the surface of the developing roller 3. Thus, the surface potential of the toner layer on the first dielectric portion and the second dielectric portion 32 is changed to a negative side. Accordingly, as illustrated in FIG. 7D, the microfield E is formed. At that time, as illustrated in FIG. 7E, the no-charged or low-charged toner particles are attracted to the first dielectric portion 31 that forms the microfield E due to the gradient force. The surface of the toner layer 5 forms irregularity on the surface of the developing roller 3. The irregularity further traps the toner 5. As a result, as illustrated in FIG. 7F, about four layers of toner are formed.

Figure 8A:
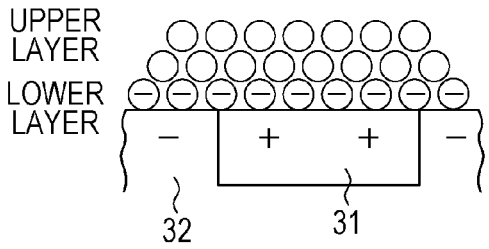
FIGS. 8A to 8F illustrate a mechanism for regulating the thickness of a toner layer in a regulating unit according to the second exemplary embodiment.
Figure 8D:
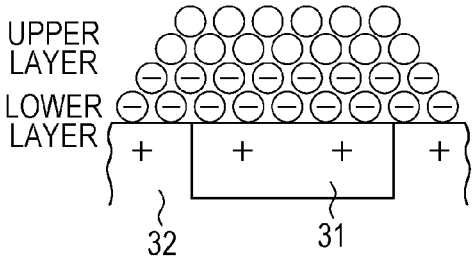
Figure 8B:
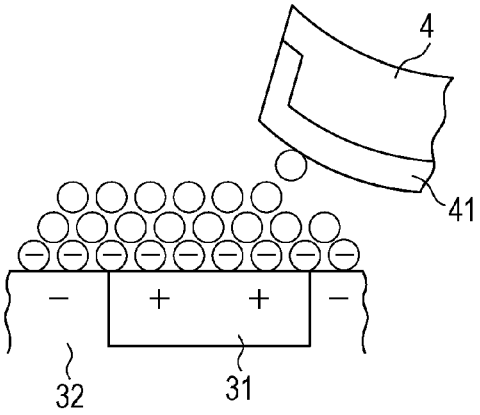
Figure 8E:
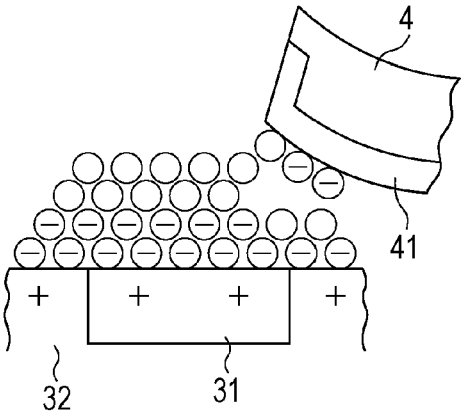
Figure 8C:
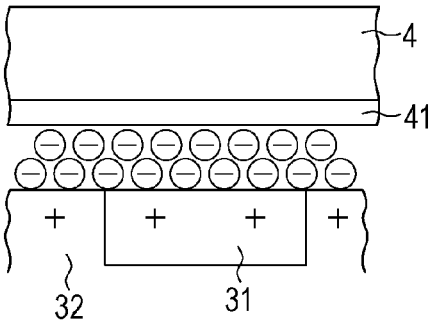
Figure 8F:
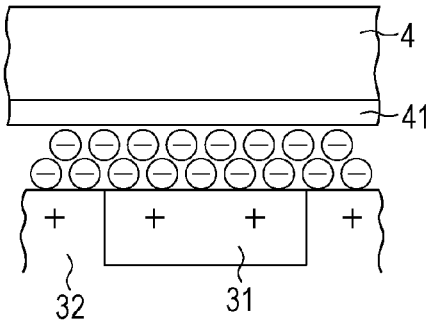
Figure 9A:
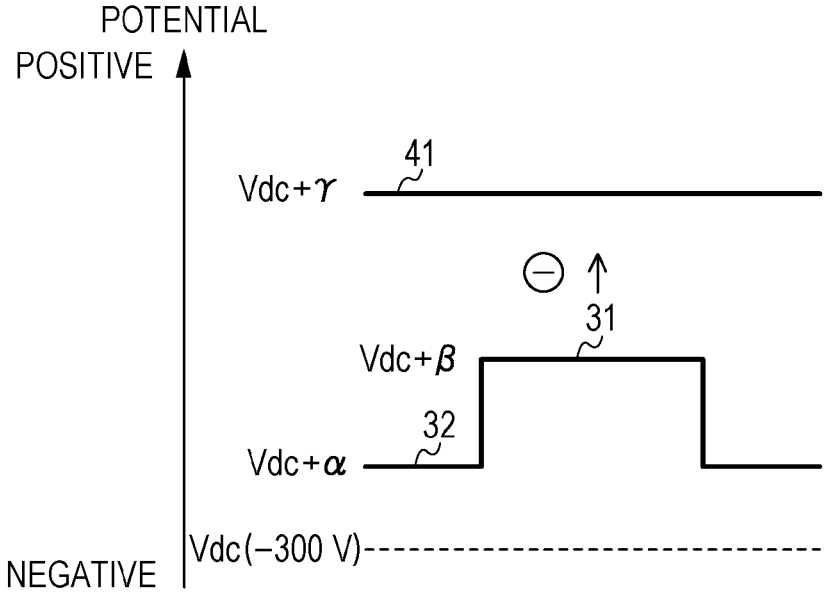
FIGS. 9A and 9B are schematic illustrations of a potential relationship among two dielectric portions and a charged layer according to the second exemplary embodiment.
Figure 9B:
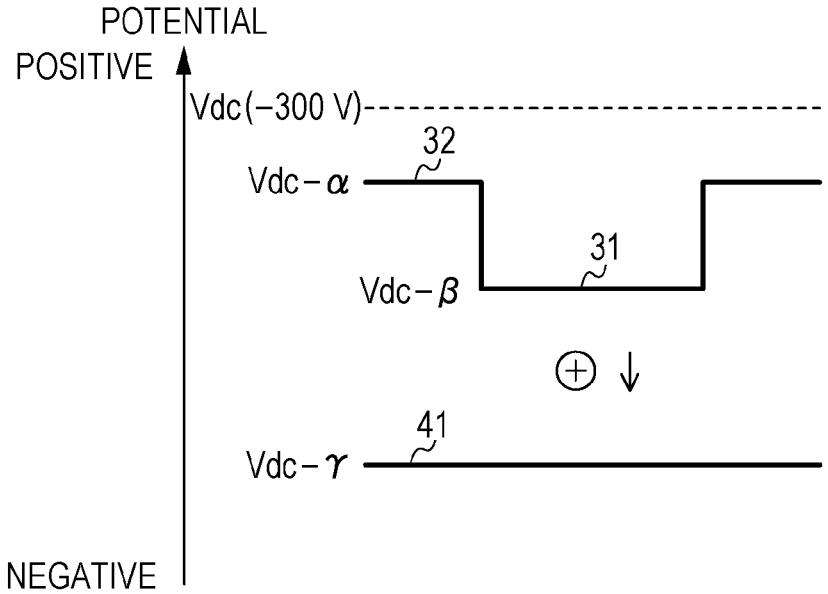

A mechanism for regulating a toner layer by the development blade 4 is described below with reference to FIGS. 8A to 8F and FIGS. 9A and 9B. FIGS. 8A to 8F illustrate a mechanism for regulating the thickness of a toner layer in the regulating unit according to the second exemplary embodiment. More specifically, FIGS. 8A to 8C illustrate a mechanism for regulating the thickness of a toner layer in the regulating unit when a solid image is formed. FIGS. 8D to 8F illustrate a mechanism for regulating the thickness of a toner layer in the regulating unit when a solid white image is formed. FIGS. 9A and 9B are schematic illustrations of the potentials of charged layers of the first dielectric portion 31, the second dielectric portion 32, and the development blade 4 according to the second exemplary embodiment. More specifically, FIG. 9A illustrates the potentials of charged layers when the toner is charged to a negative polarity, and FIG. 9B illustrates the potentials of charged layers when the toner is charged to a positive polarity.

As illustrated in FIG. 8A, when a solid image is formed, about three layers of toner are formed on the surface of the developing roller 3. In addition, as illustrated in FIG. 8B, the toner particles in the upper toner layer that are weakly restrained by the gradient force are mechanically removed from the surface of the developing roller 3 in the regulating unit. As illustrated in FIG. 8C, the toner particles of the lower toner layer are conveyed to the regulating unit and are charged to a negative polarity. In addition, at that time, since the toner particles are in slide contact with the developing roller 3, the first dielectric portion 31 and the second dielectric portion 32 are charged to a positive polarity.

In contrast, as illustrated in FIG. 8D, when a solid white image is formed, about four layers of toner are formed on the surface of the developing roller 3. As illustrated in FIG. 8E, the toner particles in the upper toner layer that are weakly restrained by the gradient force are mechanically removed from the surface of the developing roller 3 in the regulating unit. As illustrated in FIG. 8F, the toner particles in the lower toner layer are conveyed to the regulating unit and are charged to a negative polarity.

In this case, according to the second exemplary embodiment, a triboelectric series of (–) the toner 5<the second dielectric portion 32<the charging auxiliary sheet 7<the first dielectric portion 31<the charged layer 41 (positive) is established. As illustrated in FIG. 9A, the potential relationship among the first dielectric portion 31, the second dielectric portion 32, and the charged layer 41 is set as follows:

The second dielectric portion 32=the development bias (hereinafter referred to as "Vdc")+$\alpha$, the first dielectric portion 31=Vdc+$\beta$, and the charged layer 41=Vdc+$\gamma$ (Due to the difference in the work function, $\alpha<\beta<\gamma$).

In this manner, as illustrated in FIG. 8E, the negative toner particles on the surface of the developing roller 3 are easily removed from the surface of the developing roller 3 due to the electric fields between the charged layer 41 and each of the first dielectric portion 31 and the second dielectric portion 32. At that time, the negative toner particles are accumulated in a layer upper than in the case in which a solid image is formed. Accordingly, the amount of toner removed by the electric field increases.

According to the second exemplary embodiment, through the mechanism by which toner is attracted to the developing roller 3 and the toner layer regulating mechanism described above, the amount of toner coat after the toner passes through the regulating unit when a solid image is formed can be made the same as the amount of toner coat after the toner passes through the regulating unit when a solid white image is formed. As a result, the occurrence of a ghost image can be significantly reduced.

While the second exemplary embodiment has been described with reference to solid image formation and solid white image formation in which the conditions of toner coat on the surface of the developing roller 3 maximally vary, the amounts of toner coat after the toner passes through the regulating unit can be made the same even when a halftone image is formed by employing the above-described mechanisms.

In addition, like the first exemplary embodiment, according to the second exemplary embodiment, the contact pressure between the charging auxiliary sheet 7 and the developing roller 3 is set to such contact pressure that the toner can pass through a gap between the charging auxiliary sheet 7 and the developing roller 3. Accordingly, the stress imposed on the toner can be significantly reduced.

Furthermore, like the first exemplary embodiment, according to the second exemplary embodiment, an insulating polyimide resin sheet is used as the charging auxiliary sheet 7. If the charging auxiliary sheet 7 and the first dielectric portion 31 are friction charged, the charging auxiliary sheet 7 is charged to a negative polarity. In contrast, if the charging auxiliary sheet 7 and the second dielectric portion 32 are friction charged, the charging auxiliary sheet 7 is charged to a positive polarity. In this manner, since positive charge and negative charge alternately appear, charge-up of the charging auxiliary sheet 7 can be prevented. Accordingly, the charging ability of the charging auxiliary sheet 7 does not decrease. Thus, the charging auxiliary sheet 7 can reliably charge the first dielectric portions 31 having a high specific resistance and the second dielectric portion 32 having a medium specific resistance in the surface of the developing roller 3 so as to form microfields.

As described above, according to the second exemplary embodiment, the developing device 2 is configured so that microregions of the first dielectric portion 31 and the second dielectric portion 32 are mixedly exposed from the surface of the developing roller 3. In addition, the materials of the first dielectric portion 31, the second dielectric portion 32, the charging auxiliary sheet 7, the toner 5, and the charged layer 41 are selected so that a triboelectric series of (−) the toner 5<the second dielectric portion 32<the charging auxiliary sheet 7<the first dielectric portion 31<the charged layer 41 (+) is established. In this manner, a compact and low-cost developing device that does not include a toner supplying roller can reduce ghosting and solid image follow-up failure and significantly reduce deterioration of toner. When 1000 images of an A4 size were formed using an image forming apparatus including the developing device according to the second exemplary embodiment, an optimum image density was able to be maintained without an image defect and, thus, an excellent image was able to be obtained.

Note that according to the second exemplary embodiment, the first dielectric portion 31 is formed of a dielectric material having a high specific resistance, and the second dielectric portion 32 is formed of a dielectric material having a medium specific resistance. However, the materials are not limited thereto. For example, the first dielectric portion 31 may be formed of a dielectric material having a medium specific resistance, and the second dielectric portion 32 may be formed of a dielectric material having a high specific resistance. Alternatively, the first dielectric portion 31 and the second dielectric portion 32 may be formed of a dielectric material having a high specific resistance or a dielectric material having a medium specific resistance.

In the second exemplary embodiment, the first dielectric portion 31 and the second dielectric portion 32 of the developing roller 3, the charged layer 41 of the development blade 4, the charging auxiliary sheet 7, and the toner 5 are configured in accordance with the above-described material configuration. However, the material configuration of the present invention is not limited thereto. Any other material configuration that establishes a triboelectric series of (−) the toner 5<the second dielectric portion 32<the charging auxiliary sheet 7<the first dielectric portion 31<the charged layer 41 (+) may be employed. For example, if the toner is charged to a positive polarity, the materials can be configured so as to have a triboelectric series of (−) the charged layer 41<the first dielectric portion 31<the charging auxiliary sheet 7<the second dielectric portion 32<the toner 5 (+). In this manner, the potential relationship among the first dielectric portion 31, the second dielectric portion 32, and the charged layer 41 can be set to that illustrated in FIG. 9B.

In addition, if, in the triboelectric series, a difference between the charged layer 41 and each of the first dielectric portion 31 and the second dielectric portion 32 is large, the effect of removing toner from the developing roller 3 due to an electric field increases in the regulating operation. Thus, the image density may decrease. In such a case, by increasing the rotational speed of the developing roller 3, an optimum image density can be maintained.

According to the second exemplary embodiment, the conductivity of the charged layer 41 has not been mentioned. However, if the charged layer 41 is conductive, the charge-up of charge on the charged layer 41 can be prevented and, thus, excessive charge of the toner can be prevented. Even when the charged layer 41 that is conductive is employed, the above-described mechanism for reducing ghosting remains unchanged. Accordingly, the advantages that are the same as in the second exemplary embodiment can be provided.

In addition, according to the second exemplary embodiment, the development blade 4 includes the charged layer 41. However, even when the charged layer 41 is removed, any development blade 4 made of a material having a work function that establishes a triboelectric series of (−) the toner 5<the second dielectric portion 32<the charging auxiliary sheet 7<the first dielectric portion 31<the development blade 4 (+) can be employed.

Figure 10A:
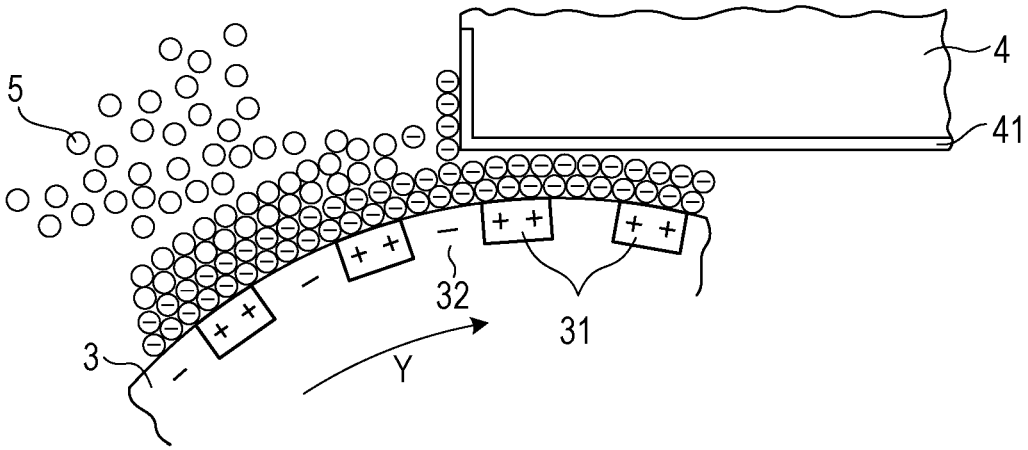
FIGS. 10A and 10B illustrate toner regulated by the top end of a development blade.
Figure 10B:
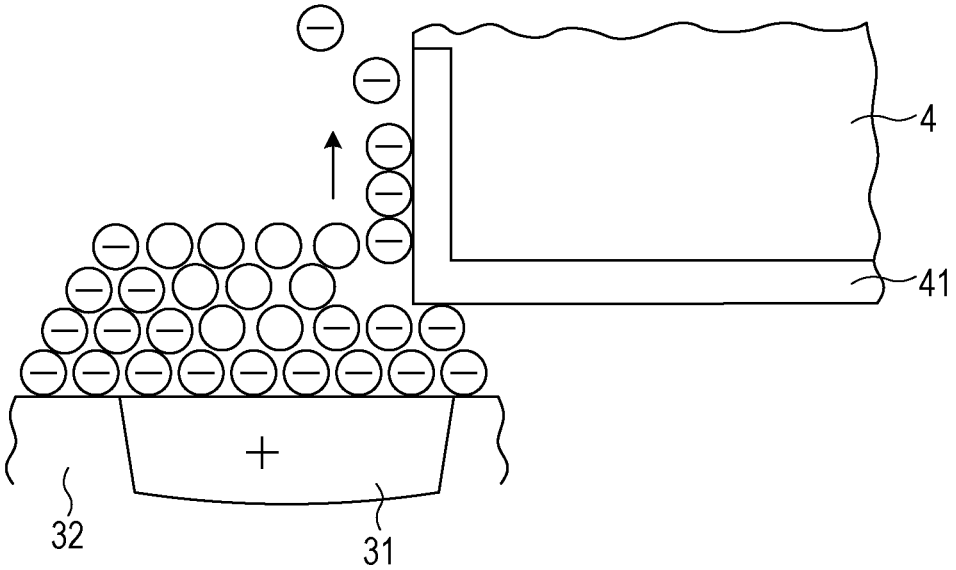

FIGS. 10A and 10B illustrate toner particles regulated by the top end of the development blade 4. According to the second exemplary embodiment, a method for contacting the developing roller 3 with the development blade 4 has not been mentioned. However, to further increase the effect of the present invention, it is desirable that as illustrated in FIG. 10A, the development blade 4 be disposed so that the top end surface of the development blade 4 is directed in a direction normal to the developing roller 3. In this manner, as illustrated in FIG. 10B, the negative toner particles in the upper layer that are removed by the electric field are attached to the charged layer 41 at the top end of the development blade 4 and are moved upward in a direction of an arrow illustrated in FIG. 10B by continuously conveyed negative toner particles. Accordingly, the negative toner particles removed by the electric field do not remain in the regulating unit. Thus, the negative toner particles in the upper layer on the surface of the developing roller 3 are more reliably removed. In this manner, the advantages that are the same as those of the second exemplary embodiment or further advantages can be provided.

While the second exemplary embodiment has been described with reference to the contact developing method in which the photosensitive drum 1 is in contact with the developing roller 3, a noncontact developing method in which the photosensitive drum 1 is not in contact with the developing roller 3 may be employed to remove pressure applied to the toner particles.

Third Exemplary Embodiment

Figure 11:
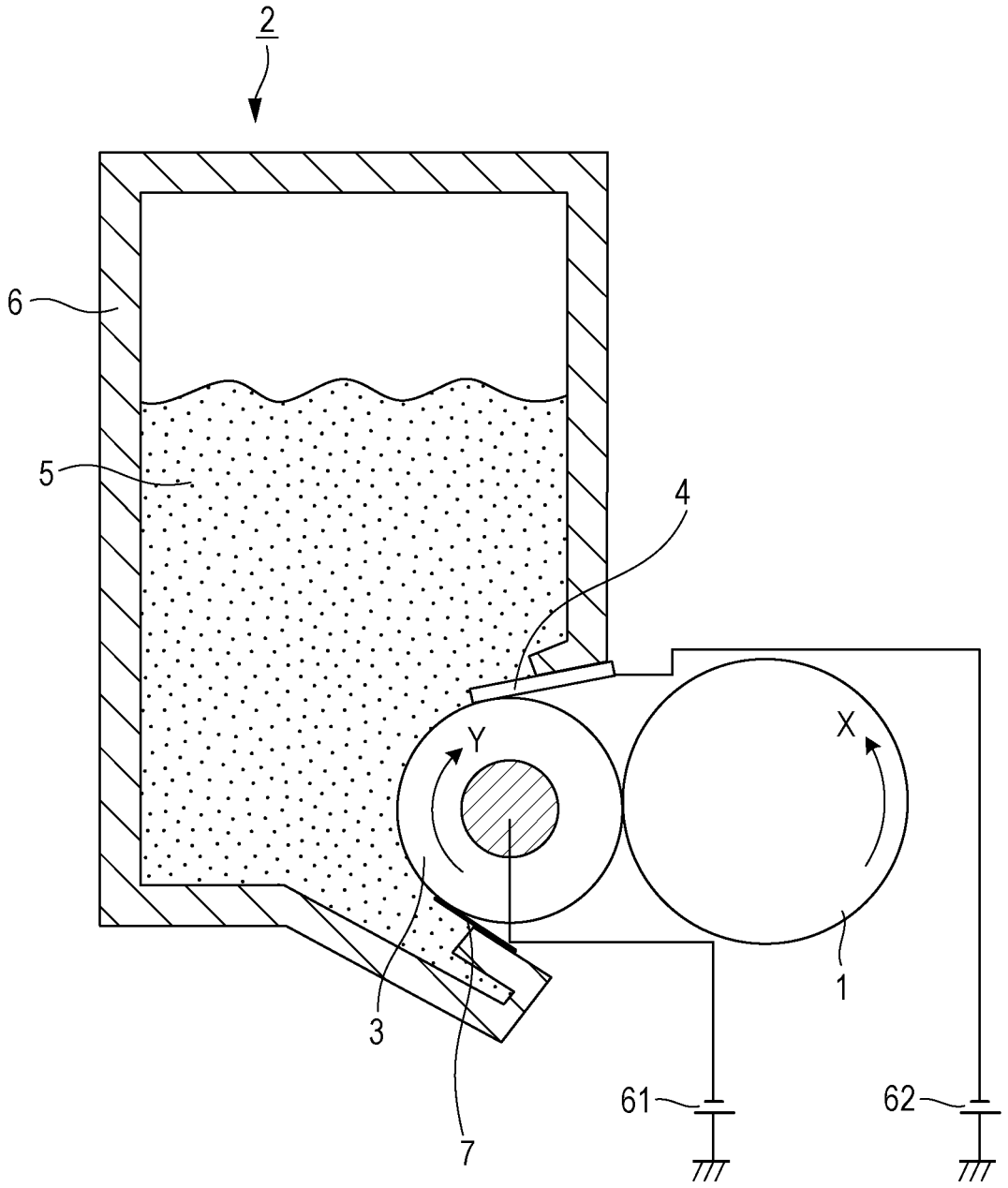
FIG. 11 is a schematic cross-sectional view of a developing device according to a third exemplary embodiment.
Figure 12A:
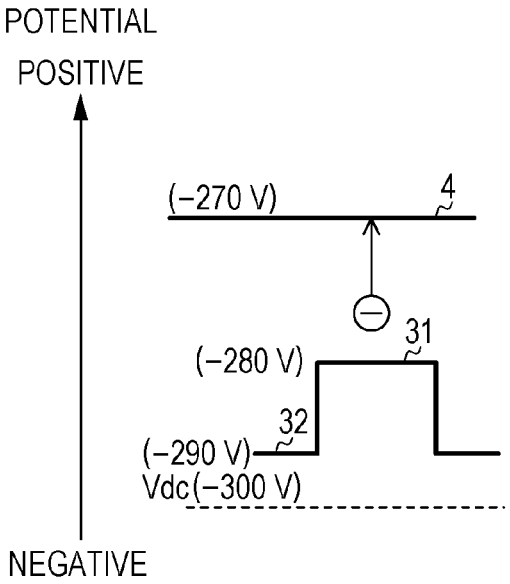
FIGS. 12A to 12D are schematic illustrations illustrating potential relationships according to the third exemplary embodiment and modifications of the third exemplary embodiment.
Figure 12B:
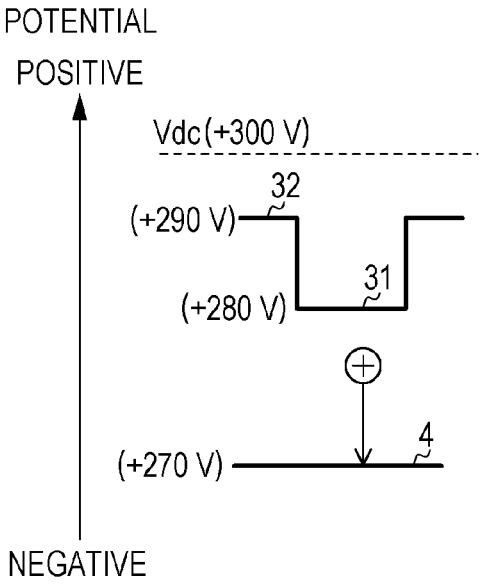
Figure 12C:
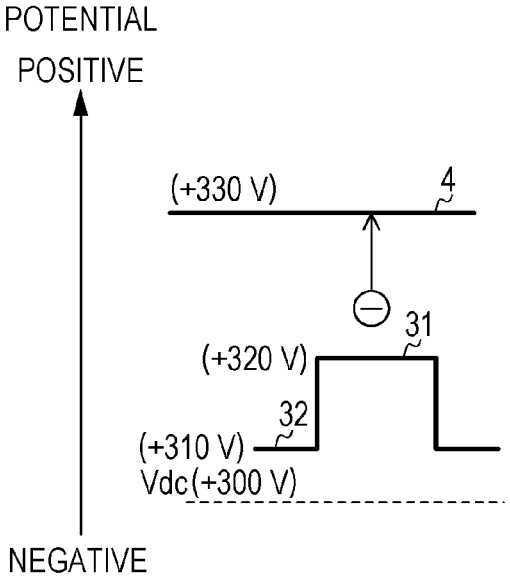
Figure 12D:
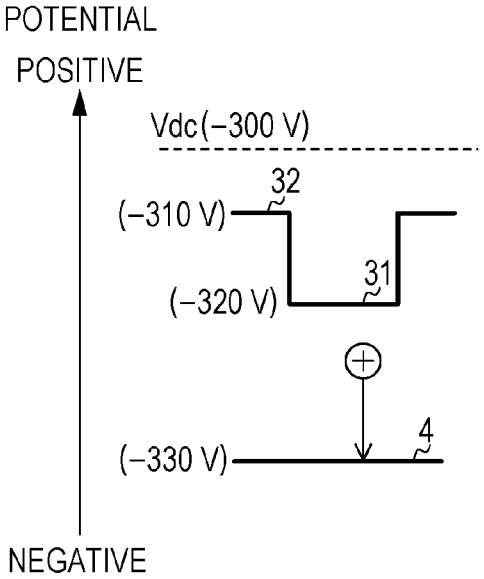

A third exemplary embodiment is described below with reference to FIG. 11 and FIGS. 12A to 12D. FIG. 11 is a schematic cross-sectional view of a developing device according to the third exemplary embodiment. FIGS. 12A to 12D are schematic illustrations illustrating potential relationships among the first dielectric portion 31, the second dielectric portion 32, the development blade 4 according to the third exemplary embodiment and a modification of the third exemplary embodiment. FIG. 12A illustrates the potential relationship according to the third exemplary embodiment in which the development bias is charged to a negative polarity and the toner is charged to a negative polarity. FIG. 12B illustrates the potential relationship according to a modification of the third exemplary embodiment in which the development bias is charged to a positive polarity and the toner is charged to a positive polarity. FIG. 12C illustrates the potential relationship according to a modification of the third exemplary embodiment in which the development bias is charged to a positive polarity and the toner is charged to a negative polarity. FIG. 12D illustrates the potential relationship according to a modification of the third exemplary embodiment in which the development bias is charged to a negative polarity and the toner is charged to a positive polarity. In any case, the potential relationship is set so that an electric field that removes toner particles from the first dielectric portion 31 is generated.

Unlike the developing device according to the first exemplary embodiment illustrated in FIG. 1, in the developing device 2 according to the third exemplary embodiment, the development blade 4 does not include the charged layer 41. In addition, the image forming apparatus according to the third exemplary embodiment includes a bias applying unit 62 serving as a second voltage applying unit that applies a voltage to the development blade 4. By applying a voltage (a blade bias) to the development blade 4 using the bias applying unit 62, the amount of toner coat on the surface of the developing roller 3 can be controlled. The other configurations are the same as in the first exemplary embodiment. Accordingly, the same reference numerals are used for the same configurations, and descriptions of the same configurations are not repeated.

Like the first and second exemplary embodiments, according to the third exemplary embodiment, the surface of the developing roller 3 is configured so that microregions of the first dielectric portion 31 and the second dielectric portion 32 are mixedly exposed on the surface. In addition, according to the third exemplary embodiment, the materials of the first dielectric portion 31, the second dielectric portion 32, the charging auxiliary sheet 7, and the toner 5 are selected so that a triboelectric series of (−) the toner 5<the second dielectric portion 32<the charging auxiliary sheet 7<the first dielectric portion 31 (+) is established.

According to the third exemplary embodiment, to generate an electric field that removes toner particles from the first dielectric portion 31 and the second dielectric portion 32 using the blade bias applied by the bias applying unit 62, the potentials of the dielectric portions during image formation need to be accurately obtained. The potential measurement according to the third exemplary embodiment was performed in the following steps:

(1) removing the developing roller 3 after a solid white image was formed and cutting the developing roller 3 to obtain a measurement sample having a size of 1 cm×1 cm and a thickness of 3 mm.

(2) after 30 minutes elapsed since image formation, measuring the potentials of the first dielectric portion 31 of the sample having a high specific resistance and the second dielectric portion 32 of the sample having a medium specific resistance using a scanning probe microscope (Model SPA300 available from SII NanoTechnology Inc.) in KFM mode.

(3) calculating potential attenuation in 30 minutes using the relative permittivity and the specific resistance of each of the first dielectric portion 31 and the second dielectric portion 32 and determining the potentials of the dielectric portions at the time of image formation.

According to the third exemplary embodiment, the potentials of the first dielectric portion 31 and the second dielectric portion 32 measured in the above-described step (2) was 11 V and 2.5 V, respectively. Since the first dielectric portion 31 (polyester resin particles) employed in the third exemplary embodiment had a relative permittivity of 3.2, a specific resistance of 1E+14 (Ω·m), and a potential attenuation ratio of 47%, the potential of the first dielectric portion 31 during image formation was 20.8 V. In contrast, since the second dielectric portion 32 (urethane) had a relative permittivity of 7, a specific resistance of 2E+13 (Ω·m), and a potential attenuation ratio of 76%, the potential of the second dielectric portion 32 during image formation was 10.7 V.

The evaluation result according to the third exemplary embodiment when a blade bias is applied by the bias applying unit 62 and an image is formed is illustrated in Table 1. According to the third exemplary embodiment, toner having a negative polarity is used. Accordingly, if a blade bias relative to developing roller bias is set to positive, the electric field is generated in a direction in which the toner 5 moves from the surface of the developing roller 3 to the development blade 4. As used herein, the term "blade bias relative to developing roller bias" refers to the value (blade bias−development bias), that is, a potential difference between the developing roller 3 and the development blade 4.

TABLE 1

| Blade Bias Relative to Developing Roller Bias | Ghosting | Density |
|---|---|---|
| −50 V | x | ○ |
| 0 V | x | ○ |
| 10 V | x | ○ |
| 20 V | Δ | ○ |

TABLE 1-continued

| Blade Bias Relative to Developing Roller Bias | Ghosting | Density |
|---|---|---|
| 30 V | ○ | ○ |
| 100 V | ○ | Δ |

Evaluation Criteria
Ghosting
○: None
Δ: Rare, allowable level
x: unallowable level
Density
○: No Low Density
Δ: allowable level
x: unallowable level As can be seen from Table 1, by changing the blade bias relative to developing roller bias from negative to positive, the occurrence of a ghost image is reduced. In this case, the ghosting is reduced in the same manner as in the first exemplary embodiment. That is, this is because the third and fourth layers of toner illustrated in FIGS. 8B and 8E are removed by the electric field generated by the blade bias relative to developing roller bias. Immediately before the toner enters the regulating unit, a larger amount of toner is carried on the developing roller 3 after a solid white image is formed than after a solid image is formed. Accordingly, the removability after a solid white image is formed is important.

In addition, after the negatively charged toner 5 enters the regulating unit, the toner 5 moves from the surface of the developing roller 3 toward the development blade 4. According to the third exemplary embodiment, the potential difference of the first dielectric portion 31 relative to the potential of the developing roller is about 20 V. Thus, the occurrence of a ghost image is significantly reduced when the blade bias relative to developing roller bias is in the range of +20 V to +30 V. In addition, by increasing the blade bias relative to developing roller bias to the positive side, the effect of the electric field to remove toner on the developing roller 3 is increased during the regulating operation. Thus, by increasing the rotational speed of the developing roller, an appropriate image density can be maintained, although the image density is decreased.

FIG. 12A illustrates a potential relationship of the third exemplary embodiment when the toner has a negative polarity and the development bias Vdc has a negative polarity. If the development bias Vdc applied to the developing roller 3 is set to −300 V, the first dielectric portion 31 has −280 V, and the second dielectric portion 32 has −290 V. If the blade bias is set to −270 V (the blade bias relative to developing roller bias is +30 V), an electric field that removes the toner from the first dielectric portion 31 and the second dielectric portion 32 is generated.

Similarly, as a modification of the third exemplary embodiment, FIG. 12B illustrates a potential relationship when the toner has a positive polarity and the development bias Vdc has a positive polarity. In addition, FIG. 12C illustrates a potential relationship when the toner has a negative polarity and the development bias Vdc has a positive polarity. FIG. 12D illustrates a potential relationship when the toner has a positive polarity and the development bias Vdc has a negative polarity.

As described above, according to the third exemplary embodiment, the surface of the developing roller 3 is configured so that microregions of the first dielectric portion 31 and the second dielectric portion 32 are mixedly exposed on the surface. In addition, the absolute values of the potentials of the second dielectric portion 32, the first dielectric portion 31, the development blade 4, and the developing roller 3 are set so as to satisfy the potential relationship illustrated in FIG. 12A. That is, the absolute value of the voltage applied to the development blade 4 by the bias applying unit 62 is set so as to be greater than the absolute value of the voltage applied to the developing roller 3 by the development bias applying unit 61. In addition, the charging auxiliary sheet 7 is disposed at a position downstream of the developing unit in the rotational direction of the developing roller 3 so as to be in slide contact with the surface of the developing roller 3 when a solid image is formed. In this manner, a compact and low-cost developing device that significantly reduces ghosting and the solid image follow-up failure while reducing the load imposed on the toner can be provided without including a developer feed member. When 1000 images of an A4 size were formed using an image forming apparatus including the developing device according to the third exemplary embodiment using the potential relationship among the second dielectric portion 32, the first dielectric portion 31, and the blade bias illustrated in FIG. 12A, an optimum image density was able to be maintained without an image defect and, thus, an excellent image was able to be obtained.

According to the third exemplary embodiment, the materials of the development blade 4, the first dielectric portion 31, the second dielectric portion 32, and the toner 5 are selected according to the material configuration described above. However, any material configuration that allows the second dielectric portion 32 to be positioned between the toner 5 and the first dielectric portion 31 in a triboelectric series and that allows the blade to have conductivity in order to apply a bias to blade can be employed. For example, if the toner 5 has a positive polarity, the materials are selected so that a triboelectric series of (−) the first dielectric portion 31<the charging auxiliary sheet 7<the second dielectric portion 32<the toner 5 (+) is established. In addition, by applying a negative potential that is greater than the absolute value of the amount of electrical charge of the first dielectric portion 31 to the development blade 4, the potential relationship among the second dielectric portion 32, the first dielectric portion 31, and the development blade 4 can be set to that illustrated in FIG. 12B.

If the difference between the potential of the first dielectric portion 31 after the first dielectric portion 31 is charged and the bias of the development blade 4 is large, the effect of the electric field to remove toner particles on the developing roller 3 may become large during the regulating operation and, thus, the image density may decrease. In such a case, by increasing the rotational speed of the developing roller, an appropriate image density can be maintained.

Finally, the advantages of the above-described exemplary embodiments are summarized. That is, according to the configurations described in the exemplary embodiments above, the developing device can be made compact and low cost. In addition, the developing device can reduce the occurrence of an image defect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-173700 filed Aug. 23, 2013, which is hereby incorporated by reference herein in its entirety.

What is claimed is:

1. A developing device comprising:

a developer bearing member configured to bear a developer on a surface thereof in order to supply the developer to an image bearing member, the developer bearing member having a first dielectric portion and a second dielectric portion in the surface thereof;

a regulating member configured to regulate a thickness of a layer of the developer carried by the developer bearing member; and a flexible sheet-like charging auxiliary member disposed so as to be in contact with the developer bearing member at a position downstream of a contact portion between the developer bearing member and the image bearing member and upstream of a contact portion between the developer bearing member and the regulating member in a rotational direction of the developer bearing member, the charging auxiliary member charging the developer carried by the developer bearing member, wherein in a triboelectric series, the charging auxiliary member is positioned between the first dielectric portion and the second dielectric portion.

2. The developing device according to claim 1, wherein work functions of the first dielectric portion and the second dielectric portion differ from each other.

3. The developing device according to claim 1, wherein the regulating member includes a charged layer that is in contact with the developer bearing member, and wherein in a triboelectric series, each of the first dielectric portion and the second dielectric portion is positioned between the developer and the charged layer.

4. The developing device according to claim 1, wherein in a triboelectric series, the first dielectric portion and the second dielectric portion are positioned on the same polarity side as the developer.

5. A developing device comprising:

a developer bearing member configured to bear a developer on a surface thereof in order to supply the developer to an image bearing member, the developer bearing member having first dielectric portions and second dielectric portions dispersed throughout the surface thereof;

a regulating member configured to regulate a thickness of a layer of the developer carried by the developer bearing member, the developer bearing member having a charged layer that is in contact with the developer bearing member; and a charging auxiliary member disposed so as to be in contact with the developer bearing member at a position downstream of a contact portion between the developer bearing member and the image bearing member and upstream of a contact portion between the developer bearing member and the regulating member in a rotational direction of the developer bearing member, the charging auxiliary member charging the developer carried by the developer bearing member, wherein in a triboelectric series, the charging auxiliary member is positioned between the first dielectric portion and the second dielectric portion, and wherein in a triboelectric series, each of the first dielectric portions and the second dielectric portions is positioned between the developer and the charged layer.

6. The developing device according to claim 1, further comprising:

a container configured to contain the developer, wherein the charging auxiliary member is a developer leakage prevention sheet that prevents the developer from leaking out of the container.

7. An image forming apparatus comprising:

a developer bearing member configured to bear a developer on a surface thereof in order to supply the developer to an image bearing member, the developer bearing member having a first dielectric portion and a second dielectric portion in the surface thereof;

a regulating member configured to regulate a thickness of a layer of the developer carried by the developer bearing member;

a flexible sheet-like charging auxiliary member disposed so as to be in contact with the developer bearing member at a position downstream of a contact portion between the developer bearing member and the image bearing member and upstream of a contact portion between the developer bearing member and the regulating member in a rotational direction of the developer bearing member, the charging auxiliary member charging the developer carried by the developer bearing member;

a first voltage applying unit configured to apply a voltage to the developer bearing member; and a second voltage applying unit configured to apply a voltage to the regulating member, wherein in a triboelectric series, the charging auxiliary member is positioned between the first dielectric portion and the second dielectric portion, and wherein the first voltage applying unit applies the voltage to the developer bearing member and the second voltage applying unit applies the voltage to the regulating member so as to generate an electric field that moves the developer from the first dielectric portions to the regulating member.

8. The image forming apparatus according to claim 7, wherein if the developer has a negative polarity, an absolute value of the voltage applied by the second voltage applying unit is greater than an absolute value of the voltage applied by the first voltage applying unit, and wherein if the developer has a positive polarity, an absolute value of the voltage applied by the second voltage applying unit is less than an absolute value of the voltage applied by the first voltage applying unit.

9. The image forming apparatus according to claim 7, wherein work functions of the first dielectric portion and the second dielectric portion differ from each other.

10. The image forming apparatus according to claim 7, wherein the regulating member includes a charged layer that is in contact with the developer bearing member, and wherein in a triboelectric series, each of the first dielectric portion and the second dielectric portion is positioned between the developer and the charged layer.

11. The image forming apparatus according to claim 7, wherein in a triboelectric series, the first dielectric portion and the second dielectric portion are positioned on the same polarity side as the developer.

12. An image forming apparatus comprising:

a developer bearing member configured to bear a developer on a surface thereof in order to supply the developer to an image bearing member, the developer bearing member having first dielectric portions and second dielectric portions dispersed in the surface thereof;

a regulating member configured to regulate a thickness of a layer of the developer carried by the developer bearing member, the developer bearing member having a charged layer that is in contact with the developer bearing member;

a charging auxiliary member disposed so as to be in contact with the developer bearing member at a position downstream of a contact portion between the developer bearing member and the image bearing member and upstream of a contact portion between the developer bearing member and the regulating member in a rotational direction of the developer bearing member, the charging auxiliary member charging the developer carried by the developer bearing member;

a first voltage applying unit configured to apply a voltage to the developer bearing member; and a second voltage applying unit configured to apply a voltage to the regulating member, wherein in a triboelectric series, the charging auxiliary member is positioned between the first dielectric portion and the second dielectric portion, wherein in the triboelectric series, each of the first dielectric portions and the second dielectric portions is positioned between the developer and the charged layer, and wherein the first voltage applying unit applies the voltage to the developer bearing member and the second voltage applying unit applies the voltage to the regulating member so as to generate an electric field that moves the developer from the first dielectric portions to the regulating member.

13. The image forming apparatus according to claim 12, wherein if the developer has a negative polarity, an absolute value of the voltage applied by the second voltage applying unit is greater than an absolute value of the voltage applied by the first voltage applying unit, and wherein if the developer has a positive polarity, an absolute value of the voltage applied by the second voltage applying unit is less than an absolute value of the voltage applied by the first voltage applying unit.

14. The image forming apparatus according to claim 12, further comprising:

a container configured to contain the developer, wherein the charging auxiliary member is a developer leakage prevention sheet that prevents the developer from leaking out of the container.

* * * * *